US006909226B2

(12) United States Patent
Suzuki

(10) Patent No.: US 6,909,226 B2
(45) Date of Patent: Jun. 21, 2005

(54) METHOD FOR MANUFACTURING SPARK PLUG, AND SPARK PLUG

(75) Inventor: Akira Suzuki, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 144 days.

(21) Appl. No.: 10/372,822

(22) Filed: Feb. 26, 2003

(65) Prior Publication Data

US 2003/0168954 A1 Sep. 11, 2003

(30) Foreign Application Priority Data

Feb. 27, 2002 (JP) ..... 2002-051257

(51) Int. Cl.[7] ..... H01T 13/02
(52) U.S. Cl. ..... 313/143; 313/144
(58) Field of Search ..... 313/143, 144; 123/169 P

(56) References Cited

U.S. PATENT DOCUMENTS 6,414,420 B1 7/2002 Suzuki

FOREIGN PATENT DOCUMENTS

EP 1022829 A1 * 7/2000 ..... H01T/13/36

* cited by examiner

*Primary Examiner*—Vip Patel
*Assistant Examiner*—Glenn D. Zimmerman
(74) *Attorney, Agent, or Firm*—Sughrue Mion, PLLC

(57) ABSTRACT

An insulator (2) is inserted into a metallic shell (1) in the direction of an axis O, and a sealing material powder (160) is charged into a circumferential gap (20) formed between the inner circumferential surface of a rear end portion of the metallic shell (1) and the outer circumferential surface of the insulator (2). The compressed sealing-material-powder layer (61) contains talc in an amount of from 75% to 99.7% by mass and at least one of magnesite and dolomite in an amount of from 0.3% to 25% by mass, and satisfies $0.5 \leqq M \leqq 1.3$ and $0.5 \leqq L \leqq 2 \times (M \times 4.5)$, wherein L in mm represents height as measured in the direction of the axis O, and M in mm represents thickness as measured radially with respect to the axis O.

5 Claims, 7 Drawing Sheets

METHOD FOR MANUFACTURING SPARK PLUG, AND SPARK PLUG

BACKGROUND OF THE INVENTION

1. Field of the Invention

The present invention relates to a spark plug for providing ignition in an internal combustion engine.

2. Description of the Related Art

A spark plug includes a tubular metallic shell and a rod-like insulator axially inserted into the metallic shell and has a spark discharge gap formed at one end of the insulator. The spark plug is mounted on an internal combustion engine by means of a male-threaded portion of the metallic shell such that the spark discharge gap is located within a combustion chamber of the engine. Since a combustion gas establishes high temperature and high pressure within the combustion chamber, sealing must be established against the outer surface of the insulator and against the inner surface of the metallic shell by a certain method in order to prevent leakage of the combustion gas. A conventionally known spark plug achieves such sealing by employing a sealing-material-powder layer formed from talc or the like. Specifically, a circumferential gap is formed between the inner circumferential surface of a rear end portion of the metallic shell and the outer circumferential surface of the insulator and is filled with a sealing material powder. While this sealing-material-powder layer is being compressed, a rear end portion of the metallic shell is crimped toward the insulator, thereby simultaneously performing assembly of the metallic shell and the insulator and sealing by means of the sealing-material-powder layer. Notably, when the insulator is subjected to an impact force, the sealing layer is compression-deformed to thereby alleviate the impact force; i.e., the sealing layer also serves as a cushion layer.

Recently, an increase in output of an internal combustion engine for use in an automobile or the like has been accompanied by an increase in the area occupied by an intake valve and an exhaust valve within a combustion chamber. Therefore, the size of a spark plug for igniting an air-fuel mixture must be reduced. With regard to a metallic shell, there is arising a demand for reduction in size with respect to a portion other than a male-threaded portion; specifically, a hexagonal portion (a tool engagement portion), which is located above the male-threaded portion and is adapted to be engaged with a wrench. This demand arises from the following reasons: employment of a direct ignition method—in which individual ignition coils are attached directly to upper portions of corresponding spark plugs—narrows an available space above a cylinder head; and the above-mentioned increase in area occupied by valves forces a reduction in the diameter of plug holes. As a result, the opposite side-to-side dimension of the hexagonal portion must be reduced to, for example, 14 mm or less from a conventionally available dimension of 16 mm or more.

The above-mentioned hexagonal portion is formed adjacent to a front side of a crimped portion of the metallic shell. The sealing-material-powder layer, which is compressed in the course of crimping, is formed in a section that overlaps the hexagonal portion with respect to the axial direction of the metallic shell. As the opposite side-to-side dimension of the hexagonal portion is reduced, the gap between the insulator and the metallic shell, which is to be filled with the sealing material powder, becomes narrower. As a matter of course, in order to increase the gap, the wall thickness of the hexagonal portion may be reduced, or the diameter of the insulator may be reduced. However, in the former case, since the wall of the hexagonal portion becomes excessively thin, the hexagonal portion is buckled so as to swell outward in the course of crimping. In the latter case, the insulator becomes too thin, resulting in insufficient strength and thus insufficient impact resistance. Therefore, when a hexagonal portion having a small opposite side-to-side dimension is to be employed, the gap to be filled with the sealing material powder is unavoidably narrowed.

In order to seal the insulator and the metallic shell against each other, the sealing-material-powder layer must be sufficiently compressed so as to assume a certain density or higher. In this case, before crimping is started, the sealing material powder must be charged into the above-mentioned gap while being subjected to preliminary compression effected by means of a punch or the like. However, in the case where a hexagonal portion having a small opposite side-to-side dimension is employed, as mentioned above, the gap between the insulator and the metallic shell becomes narrow; thus, uniform filling with the sealing material powder becomes difficult. Specifically, when a required amount of sealing material powder is charged into a deep, narrow gap at one time while being compressed by means of a punch or the like, friction acting on the outer circumferential surface of the insulator or on the inner circumferential surface of the metallic shell causes compression, to a biasedly large extent, of powder filling an upper portion of the gap located close to the punch, while an applied force is insufficiently transmitted to powder filling a lower portion of the gap. As a result, the upper portion of the gap is filled with the powder at high density, whereas the lower portion of the gap is filled with the powder at low density. Once such nonuniform density arises, subsequent compression effected by crimping merely compresses the powder filling the upper portion of the gap, thus failing to eliminate the nonuniform condition of filling, with a resultant impairment in gastightness or impact resistance.

SUMMARY OF THE INVENTION

An object of the present invention is to provide a method for manufacturing a spark plug, capable of forming a uniform high-density sealing-material-powder layer between an insulator and a metallic shell even when the size of a tool engagement portion is reduced to 14 mm or less, to thereby attain sufficient gastightness and impact resistance, as well as to provide a spark plug manufactured by the method.

In order to achieve the above object, the present invention provides a first method for manufacturing a spark plug comprising a tubular metallic shell and a rodlike insulator axially inserted into the metallic shell, the spark plug having a spark discharge gap at one end of the insulator with respect to the direction of the axis of the insulator, a side toward the spark discharge gap with respect to the axial direction of the insulator being defined as a front side, the metallic shell configured such that a portion-to-be-crimped is formed at a rear end portion thereof and such that a tool engagement portion having an opposite side-to-side dimension not greater than 14 mm is formed in an outer surface region adjacent to the front side of the portion-to-be-crimped being prepared, the method comprising:

a sealing-material-powder charging step in which the insulator is inserted into the metallic shell in the axial direction, and a sealing material powder is charged into a circumferential gap formed between the inner circumferential surface of a rear end portion of the metallic shell and the outer circumferential surface of the insulator, such that the sealing material powder is divided into a plurality of charge units and such that a step of charging one charge unit into the gap and preliminarily compressing the charge unit in the gap is repeated to thereby form preliminarily compressed sealing-material-powder layers in the gap; and a crimping step in which the portion-to-be-crimped is curved toward the outer circumferential surface of the insulator to thereby be crimped, whereby the preliminarily compressed sealing-material-powder layers are formed into a compressed sealing-material-powder layer which satisfies $$0.5 \leqq M \leqq 1.3 \text{ and}$$

$$0.5 \leqq L \leqq 2 \times (M \times 4.5),$$

wherein L represents height as measured in the axial direction, and M represents thickness as measured radially with respect to the axis.

As mentioned above, the method of the present invention is applied to the manufacture of a spark plug configured such that the metallic shell has a tool engagement portion (e.g., a hexagonal portion) having an opposite side-to-side dimension of not greater than 14 mm; the metallic shell is fixedly attached to the insulator through crimping; and the gap between the metallic shell and the insulator is sealed by means of the compressed sealing-material-powder layer. In such a spark plug, since the opposite side-to-side dimension of the tool engagement portion is small, the above-mentioned gap to be filled with a sealing material powder is narrow. As mentioned previously, conventionally, the sealing material powder is charged into the gap and undergoes preliminary compression in a single operation, thereby involving a problem in that powder filling a lower portion of the gap has low density with a resultant failure to attain sufficient gastightness and impact resistance.

Thus, the method of the present invention divides a sealing material powder into a plurality of charge units. Charging powder into the gap and preliminarily compressing the powder are alternated such that, after one charge unit is charged into the gap, the charge unit is subjected to preliminary compression within the gap; subsequently, the next charge unit is charged into the gap and undergoes preliminary compression. As a result of dividing the sealing material powder into charge units and carrying out preliminary compression stepwise, the depth of charged powder per charge operation decreases. Thus, friction acting on the inner surface of the metallic shell and on the outer surface of the insulator exerts less influence on compression of powder, so that sufficient compression force is transmitted from a punch to a lower portion of the charged powder; therefore, each of the charge units can be preliminarily compressed at uniform density. The resultant preliminarily compressed sealing-material-powder layers assume uniform density as a whole. That is, even though the opposite side-to-side dimension of the tool engagement portion is small, sufficient sealing performance and impact resistance can be attained after crimping.

In the above-described method, a charge unit in powder form can be charged into the gap between the inner surface of the metallic shell and the outer surface of the insulator. However, when the fluidity of powder is not very high, directly charging the powder into the gap may raise a problem of, for example, the powder being trapped midway within the gap. In this case, the following preferred method may be employed: before being charged into the gap, the charge units are formed into a plurality of corresponding ringlike green bodies by means of preliminary forming; and a step of inserting one green body into the gap in the axial direction and preliminarily compressing the green body in the gap is repeated to thereby form preliminarily compressed sealing-material-powder layers. Use of such green bodies effectively prevents the powder trap problem or the like.

The green body can be formed by use of a die and press. When the above-mentioned spark plug gap is narrow and deep, a green body to be charged into the gap must be thin-walled and high. In the course of forming such a green body by use of a die and press, filling a cavity of the die with powder involves the same problem as in the case where powder is charged directly into the gap of a spark plug and compressed. According to the above-described preferred method of the present invention, the sealing material powder is not pressed in a single operation, but is divided into charge units, which are then formed into a plurality of corresponding green bodies each having low height. Thus, each of the green bodies has uniform density. Each of the green bodies disposed in the gap is compressed within the gap. Therefore, the resultant preliminarily compressed sealing-material-powder layers assume uniform density as a whole. Notably, a satisfactory strength that a green body must have is to such an extent as to be able to withstand handling involved in charging into the gap.

According to the method of the present invention, the dimensions of the compressed sealing-material-powder layer are determined so as to satisfy the following: $0.5 \leqq M \leqq 1.3$ (unit: mm) and $0.5 \leqq L \leqq 2 \times (M \times 4.5)$ (unit: mm). Values of M less than 0.5 mm raise difficulty even in charging powder into the gap; thus, even when a sealing material powder is divided into charge units as mentioned above, the resultant compressed sealing-material-powder layer fails to attain uniform density. Values of M in excess of 1.5 mm unavoidably involve either of the following: a tool engagement portion having an opposite side-to-side dimension not greater than 14 mm has an excessively thin wall; and the outside diameter of the insulator becomes excessively small. The former case is apt to involve a problem in that the tool engagement portion is buckled in such a manner as to swell outward in the course of crimping. The latter case involves insufficient strength of the insulator and thus fails to attain, for example, sufficient impact resistance.

Values of L less than 0.5 mm raise difficulty in the compressed sealing-material-powder layer providing expected impact resistance. Values of L in excess of $2 \times (M \times 4.5)$ raise a problem in that, even when a sealing material powder is divided into charge units, the resultant compressed sealing-material-powder layer fails to attain uniform density, with a resultant failure to attain expected gastightness. Notably, values of L not less than $(M \times 4.5)$ markedly yield the effect of the present invention; i.e., uniform filling density—which is attained by preliminarily compressing the sealing material powder in charge units—and resultant enhancement of gastightness and impact resistance.

The sealing material powder may predominantly contain talc. Talc is inexpensive and has relatively low friction coefficient against metal, as can be presumed from the wide use of talc as an antifriction agent. By virtue of exhibiting good characteristics in terms of compressibility, sliding on the inner circumferential surface of the metallic shell, electrical insulation, and heat resistance, talc can favorably serve as a sealing material for use in a spark plug. Since talc particles by themselves show rather low fluidity and high bulk density, talc particles do not necessarily exhibit sufficient compressibility for forming a high-density compressed sealing-material-powder layer that can endure particularly severe environmental conditions.

In order to cope with the above problem, talc particles are not used solely, but are preferably mixed with a mineral powder containing $MgCO_3$. The thus-prepared sealing material powder exhibits higher compressibility and can be more readily charged at higher density, whereby a sealing layer exhibiting high, uniform density and excellent sealing performance and impact resistance can be implemented. Examples of mineral particles formed predominantly from $MgCO_3$ include magnesite ($MgCO_3$) and dolomite ($(Mg, Ca)CO_3$). A specific, usable sealing-material-powder composition can be such that talc is contained in an amount of 75%–99.7% by mass, and mineral particles containing $MgCO_3$; for example, magnesite and/or dolomite, are contained in a total amount of 0.3%–25% by mass. When the total content of magnesite and/or dolomite is less than 0.3% by mass, improvement in compressibility is insufficient. When the total content of magnesite and/or dolomite is in excess of 25% by mass, compressibility is impaired, whereby sealing performance is impaired.

When a talc powder blended with magnesite and/or dolomite (hereinafter called a "blended talc powder") is used as a sealing material powder, the density of the compressed sealing-material-powder layer is preferably 2–2.9 g/cm$^3$, whereby the compressed sealing-material-powder layer can attain a relative density not less than 70%. By use of this blended talc powder in manufacture of a spark plug according to the method of the present invention, the relative density of the compressed sealing-material-powder layer can be increased to 70% or higher, to thereby attain excellent sealing performance. The density of the compressed sealing-material-powder layer can be measured in a manner described below. First, the compressed sealing-material-powder layer is removed from a spark plug. The total weight of the removed powder is measured. The outer-surface profile of the insulator and the inner-surface profile of the metallic shell are obtained through radiography, to thereby estimate the volume of the compressed sealing-material-powder layer. The above-obtained total weight of the powder is divided by the estimated volume, thereby yielding the density of the compressed sealing-material-powder layer.

The present invention also provides a spark plug comprising a tubular metallic shell and a rodlike insulator axially inserted into the metallic shell, the spark plug having a spark discharge gap at one end of the insulator with respect to the direction of the axis of the insulator, a side toward the spark discharge gap with respect to the axial direction of the insulator being defined as a front side, the spark plug being characterized in that:

the metallic shell is configured such that a crimped portion is formed at a rear end portion thereof in such a manner as to be curved toward the outer circumferential surface of the insulator, and such that a tool engagement portion having an opposite side-to-side dimension of not greater than 14 mm is formed in an outer surface region adjacent to the front side of the crimped portion;

the insulator is inserted into the metallic shell in the axial direction such that a compressed sealing-material-powder layer is formed in a circumferential gap formed between the inner circumferential surface of a rear end portion of the metallic shell and the outer circumferential surface of the insulator; and the compressed sealing-material-powder layer is formed from a sealing material powder (the above-mentioned blended talc powder) which contains talc in an amount of 75%–99.7% by mass and magnesite and/or dolomite in a total amount of 0.3%–25% by mass, in such a manner as to satisfy $$0.5 \leqq M \leqq 1.3 \text{ and}$$

$$0.5 \leqq L \leqq 2 \times (M \times 4.5),$$

wherein L (mm) represents height as measured in the axial direction, and M (mm) represents thickness as measured radially with respect to the axis, and to have a density of 2–2.9 g/cm$^3$.

The above-described spark plug of the present invention can be manufactured according to the previously mentioned method of the present invention, by use of a sealing-material-powder layer formed from a sealing material powder which is prepared by blending a talc powder with magnesite or dolomite. Although the tool engagement portion of the metallic shell has a small opposite side-to-side dimension; i.e., not greater than 14 mm, use of the blended talc powder implements the compressed sealing-material-powder layer that satisfies $0.5 \leqq M \leqq 1.3$ and $0.5 \leqq L \leqq 2 \times (M \times 4.5)$ (unit of L and M: mm) and has a density of 2–2.9 g/cm$^3$. As a result, excellent sealing performance can be implemented.

A further aspect of the present invention provides a method for manufacturing a spark plug comprising a tubular metallic shell and a rodlike insulator axially inserted into said metallic shell, said spark plug having a spark discharge gap at one end of said insulator with respect to a direction of an axis of said insulator, a sealing material powder being charged into a circumferential gap between said metallic shell and said insulator so as to form a sealing-material-powder layer, said method comprising the steps of:

(a) charging a portion of said sealing material powder into said circumferential gap;

(b) preliminarily compressing the portion of said sealing material powder charged in said circumference gap; and (c) charging another portion of said sealing material powder into said circumferential gap.

DESCRIPTION OF REFERENCE NUMERALS

Figure 1:
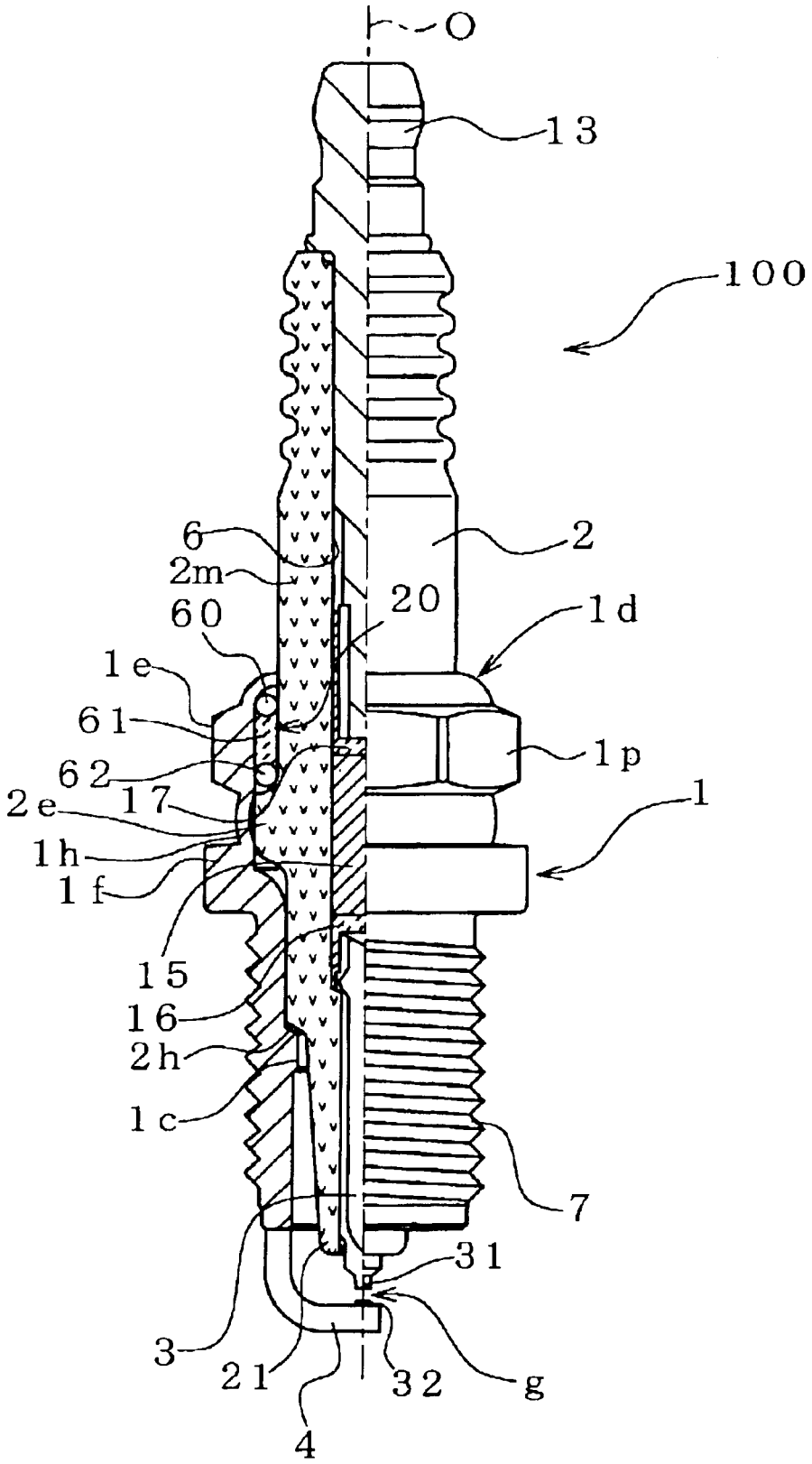
FIG. 1 is a vertical, half sectional view showing a spark plug according to an embodiment of the present invention.

1: metallic shell
1*d*': portion-to-be-crimped
1*d*: crimped portion

1*e*: tool engagement portion
2: insulator
g: spark discharge gap
20: gap
61: compressed sealing-material-powder layer
100: spark plug
160: sealing material powder
161: charge unit
162*a*, 162*b*: preliminarily compressed sealing-material-powder layer
164*a*, 164*b*: green body (preliminarily compressed sealing-material-powder layer)

DETAILED DESCRIPTION OF THE PREFERRED EMBODIMENTS

Embodiments of the invention will next be described, by way of example only.

FIG. 1 shows a spark plug 100 according to an embodiment of the present invention. The spark plug 100 includes a tubular metallic shell 1 and a rodlike insulator 2 axially inserted into the metallic shell 1 and has a spark discharge gap g at one end of the insulator 2 with respect to the direction of an axis O. Hereinafter, a side toward the spark discharge gap g with respect to the direction of the axis O of the insulator 2 is defined as the front side. The insulator 2 is inserted into the metallic shell 1 such that a distal end portion 21 projects from the metallic shell 1. A center electrode 3 is disposed in the insulator 2 such that a noble metal chip 31 welded to its distal end projects from the insulator 2. One end of a ground electrode 4 is joined to the front end face of the metallic shell 1 by means of welding or the like, and the other end portion of the ground electrode 4 is bent such that its side surface faces the noble metal chip 31 of the center electrode 3. A noble metal chip 32 is welded to the ground electrode 4 in opposition to the noble metal chip 31. The noble metal chips 31 and 32 form the spark discharge gap g therebetween.

The metallic shell 1 is formed into a tubular shape from an Fe-based metal such as carbon steel and serves as a housing of the spark plug 100. A crimped portion 1*d* is formed at a rear end portion of the metallic shell 1 in such a manner as to be curved toward the outer circumferential surface of the insulator 2, whereby the insulator 2 and the metallic shell 1 are joined. Further, a tool engagement portion 1*e* having an opposite side-to-side dimension not greater than 14 mm is formed adjacent to the front side of the crimped portion 1*d*.

Figure 2:
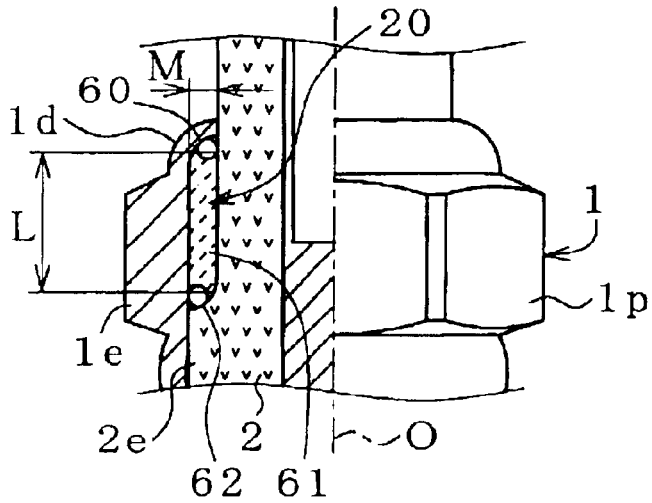
FIG. 2 is an enlarged view showing essential portions of the spark plug of FIG. 1.

As shown in FIG. 2, the tool engagement portion 1*e* has a plurality of pairs of mutually parallel tool engagement faces 1*p* extending in parallel with the axis O and arranged circumferentially. When the tool engagement portion 1*e* is to assume a regular hexagonal cross section, the tool engagement portion 1*e* has three pairs of the tool engagement faces 1*p*. Alternatively, the tool engagement portion 1*e* may have 12 pairs of the mutually parallel tool engagement faces 1*p*. In this case, the cross section of the tool engagement portion 1*e* assumes a shape obtained by shifting two superposed regular hexagonal shapes about the axis O by 30°. In either case, when the opposite side-to-side dimension of the tool engagement portion 1*e* is represented by the distance between opposite sides of the hexagonal cross section, the opposite side-to-side dimension of the tool engagement portion 1*e* is not greater than 14 mm.

Referring back to FIG. 1, on the outer circumferential surface of the metallic shell 1, a flange-like gas seal portion 1*f* is formed on the front side of the tool engagement portion 1*e* to be located adjacent thereto, and a male-threaded portion 7 is formed adjacent to the front side of the gas seal portion 1*f* and adapted to mount the spark plug 100 on an unillustrated engine block. A thin-walled portion 1*h* is formed between the tool engagement portion 1*e* and the gas seal portion 1*f*. The wall of the thin-walled portion 1*h* is thinner than that of the tool engagement portion 1*e* and that of the gas seal portion 1*f*.

The insulator 2 is formed from a ceramic sintered body such as alumina or aluminum nitride. The insulator 2 has a through-hole 6 formed therein along the direction of the axis O so as to receive the center electrode 3. A metallic terminal member 13 is fixedly inserted into one end portion of the through-hole 6, whereas the center electrode 3 is fixedly inserted into the other end portion of the through-hole 6. A resistor 15 is disposed within the through-hole 6 between the metallic terminal member 13 and the center electrode 3. Opposite end portions of the resistor 15 are electrically connected to the center electrode 3 and the metallic terminal member 13 via conductive glass seal layers 16 and 17, respectively. A flange-like protrusion 2*e* is circumferentially formed on the outer circumferential surface of the insulator at a position which is located within the metallic shell 1 with respect to the direction of the axis O of the insulator 2. A steplike insulator-side engagement portion 2*h* is formed on the insulator 2 on the front side relative to the protrusion 2*e*, and a protuberant shell-side engagement portion 1*c* is circumferentially formed on the inner circumferential surface of the metallic shell 1 at a position corresponding to the male-threaded portion 7. The shell-side engagement portion 1*c* and the insulator-side engagement portion 2*h* are engaged with each other, thereby preventing the insulator 2 from slipping forward out of the metallic shell 1.

Next, as shown in FIG. 2, a circumferential gap 20 is formed between the inner circumferential surface of a rear end portion of the metallic shell 1 and the outer circumferential surface of the insulator 2. This gap 20 is a ringlike space whose one end with respect to the direction of the axis O is closed with the crimped portion 1*d* and whose other end is closed with the protrusion 2*e* of the insulator 2. The gap 20 is filled with a compressed sealing-material-powder layer 61. The compressed sealing-material-powder layer 61 is formed from a blended talc powder which contains talc in an amount of 75%–99.7% by mass and magnesite and/or dolomite in a total amount of 0.3%–25% by mass, in such a manner as to satisfy $0.5 \leqq M \leqq 1.3$ and $0.5 \leqq L \leqq 2 \times (M \times 4.5)$ {wherein L (mm) represents height as measured in the direction of the axis O, and M (mm) represents thickness as measured radially with respect to the axis O} and to have a density of 2–2.9 g/cm$^3$. The meaning of these numerical ranges has already been described herein; therefore, repetitious description thereof is omitted.

The width M of the finally obtained compressed sealing-material-powder layer 61 is defined as the maximum dimension of the compressed sealing-material-powder layer 61 (or the gap 20) as measured radially in the cylindrical coordinates system whose axis of cylinder is the axis O of the metallic shell 1. The height L of the compressed sealing-material-powder layer 61 is measured along the direction of the axis O. Notably, when the width of the gap 20 is substantially constant as measured at an axially central portion of the gap 20 with respect to the direction of the axis O, and the width of the gap 20 reduces toward an end of the gap 20 as measured in an end-portion section, the width M of the compressed sealing-material-powder layer 61 is defined as the radial dimension of the gap 20 as measured in the central-portion section (hereinafter called the "constant-width section"). The height L of the compressed sealing-material-powder layer 61 is determined such that, in an end portion of the gap 20, a position where the width is reduced to ½ that of the constant-width section (i.e., a position where the width is ½M) is defined as an end position of the compressed sealing-material-powder layer 61.

Figure 3:
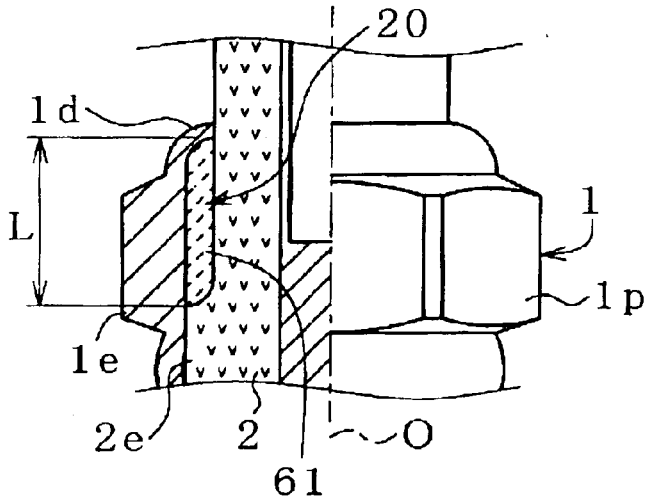
FIG. 3 is an enlarged view showing essential portions of a first modified embodiment of the spark plug of FIG. 1.
Figure 4:
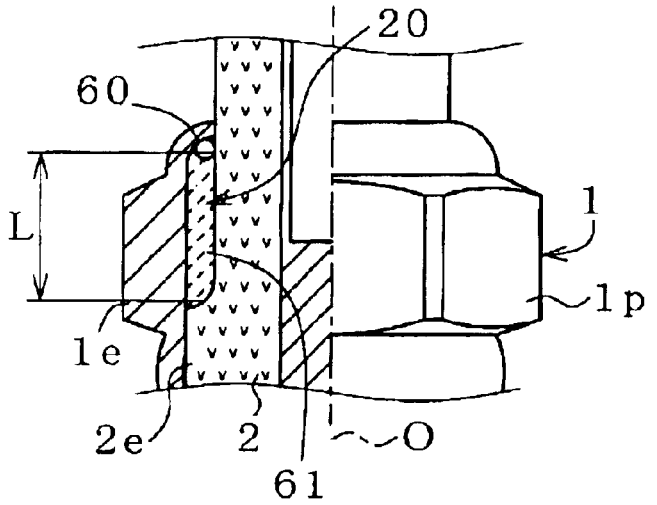
FIG. 4 is an enlarged view showing essential portions of a second modified embodiment of the spark plug of FIG. 1.

In the embodiment shown in FIG. 2, ringlike packings 60 and 62 are disposed in the gap 20, in contact with axially opposite ends of the compressed sealing-material-powder layer 61 with respect to the direction of the axis O. One of the packings 60 and 62 is in contact with a rear circumferential edge of the protrusion 2*e*, while the other is in contact with a rear end of the inner circumferential surface of the crimped portion 60. The packings 60 and 62 reinforce the effect of the compressed sealing-material-powder layer 61 in terms of sealing against the metallic shell 1 and against the insulator 2. As shown in FIG. 3, these packings 60 and 62 may be eliminated such that the gap 20 is entirely filled with the compressed sealing-material-powder layer 61. In this case, the compressed sealing-material-powder layer 61 alone seals against the metallic shell 1 and against the insulator 2. As shown in FIG. 4, only the packing 62, which would otherwise be in contact with the protrusion 2*e*, may be eliminated.

Next, an embodiment of a method for manufacturing the above-described spark plug 100 will be described. First, the metallic shell 1 is prepared. As a matter of course, the crimped portion 1*d* is not formed yet. Specifically, as shown in Step (1) of FIG. 5, the crimped portion 1*d* is in the form of a portion-to-be-crimped 1*d*', which is not curved but assumes the form of a right cylinder. The insulator 2 to which the center electrode 3, the conductive seal layers 16 and 17, the resistor 15, and the metallic terminal member 13 are attached beforehand is inserted in the direction of the axis O into the metallic shell 1 through the rear end opening of the portion-to-be-crimped 1*d*'. The insulator-side engagement portion 2*h* and the shell-side engagement portion 1*c* are engaged with each other via a thread packing (not shown) (see FIG. 1 for these members). As a result, as shown in Step (1) of FIG. 5, the previously mentioned gap 20 is formed while its rear end is open.

Next, the thread packing 62 is inserted into the metallic shell 1 through an insertion opening portion of the metallic shell 1 and is disposed on the rear side of the flange-like protrusion 2*e*. As shown in Step (2), the gap 20 is charged with a sealing material powder 160. In preparation for this charging operation, the sealing material powder 160 is divided into a plurality of (two in the present embodiment) charge units 161 of the same quantity. In step (2), the amount of the sealing material powder 160 to be charged into the gap 20 is not an amount required for forming the final compressed sealing-material-powder layer 61 (FIG. 1), but is the amount of the charge unit 161.

As shown in Step (3), the thus-charged charge unit 161 is preliminarily compressed within the gap 20 by use of a ringlike punch 163, to thereby be formed into a preliminarily compressed sealing-material-powder layer 162*a*. Subsequently to the preliminary compression, as shown in Step (4), the next charge unit 161 is charged on the preliminarily compressed sealing-material-powder layer 162*a*. Then, as shown in Step (5), the charge unit 161 is preliminarily compressed by use of the punch 163, to thereby be formed into a preliminarily compressed sealing-material-powder layer 162*b*. That is, charging the charge unit 161 into the gap 20 and preliminarily compressing the charge unit 161 by use of the punch 163 are alternated, thereby yielding the final, preliminarily compressed sealing-material-powder layers 162*a* and 162*b*.

As previously described in detail, the spark plug 100 to which the present invention is applied is configured such that the tool engagement portion 1*e* of the metallic shell 1 has a small opposite side-to-side dimension; i.e., not greater than 14 mm. Thus, the depth of the gap 20 to be filled with the sealing material powder is unavoidably increased relative to the width. When the gap 20 is to be charged with the sealing material powder in a single operation, the depth of charged powder per charge operation becomes excessively deep; as a result, the filling density of powder becomes unavoidably nonuniform. Specifically, since friction acting on the metallic shell 1 and on the insulator 2 prevents the powder from smoothly filling a lower portion of the gap 20, the density of powder in the vicinity of an end opening of the gap 20 is biasedly increased, resulting in a failure to obtain a preliminarily compressed sealing-material-powder layer of uniform density.

However, by means of dividing the powder into charge units and carrying out preliminary compression stepwise as described above, the depth of charged powder per charge operation decreases. Thus, each of the charge units can be preliminarily compressed at uniform density; i.e., the resultant preliminarily compressed sealing-material-powder layers 162*a* and 162*b* assume uniform filling density as a whole in the depth direction. In view of reliable attainment of uniform filling density, each of the preliminarily compressed sealing-material-powder layers 162*a* and 162*b* is preferably formed in such a manner as to assume a height not greater than 4.5M, wherein M represents the width of the gap 20. In order to further reduce the depth of charged powder per charge operation, the sealing material powder may be divided into three or more charge units in accordance with the width and depth of the gap 20.

Figure 6:
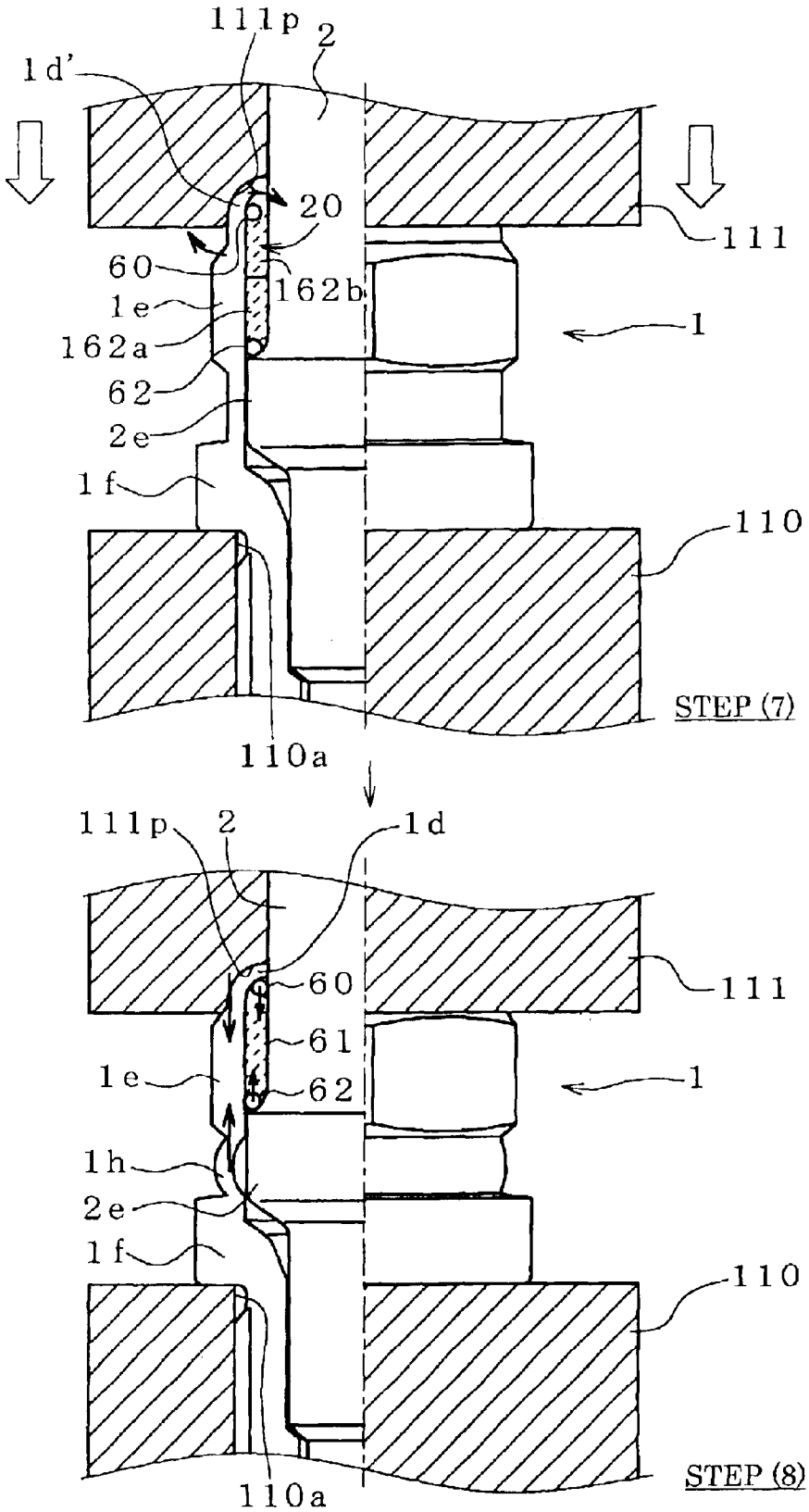
FIG. 6 shows explanatory views exemplifying steps subsequent to those of FIG. 5.

After completing formation of the preliminarily compressed sealing-material-powder layers 162*a* and 162*b*, as shown in Step (6), the packing 60 is disposed. Subsequently, a crimping step is performed. The crimping step may employ either cold crimping or hot crimping. For example, cold crimping can be performed as shown in FIG. 6. First, as shown in Step (7), a front end portion of the metallic shell 1 is inserted into a setting hole 110*a* of a crimping base 110 such that the flange-like gas seal portion 1*f* formed on the metallic shell 1 rests on the opening periphery of the setting hole 110*a*. Next, a crimping die 111 is fitted to the metallic shell 1 from above. A concave crimping action surface 111*p* corresponding to the crimped portion 1*d* (FIG. 1) is formed on a portion of the crimping die 111 which abuts the portion-to-be-crimped 1*d*'. In this state, axial compression force directed toward the crimping base 110 is applied to the crimping die 111. As shown in Step (8), the portion-to-be-crimped 1*d*' is compressed while being curved radially inward along the crimping action surface 111*p*, to thereby become the crimped portion 1*d*. Thus, the metallic shell 1 and the insulator 2 are firmly joined through crimping. The thin-walled portion 1*h* is formed between the gas seal portion 1*f* and the tool engagement portion 1*e*. As a result of application of the compression force, the thin-walled portion 1*h* is flexibly deformed in the radially outward direction, to thereby contribute toward increasing the stroke of compression of the filler layer 61, whereby sealing performance is enhanced.

As described above, the portion-to-be-crimped 1*d*' is curved toward the outer circumferential surface of the insulator 2 to thereby be crimped, whereby the metallic shell 1 and the insulator 2 are joined together. As a result of this crimping, the preliminarily compressed sealing-material-powder layers 162*a* and 162*b* are further compressed between the packings 60 and 62 to thereby become the compressed sealing-material-powder layer 61. As mentioned previously, the preliminarily compressed sealing-material-powder layers 162*a* and 162*b* have uniform filling density in the depth direction; therefore, the compressed sealing-material-powder layer 61 yielded through crimping has a uniform, high density of 2–2.9 g/cm$^3$, thereby greatly enhancing gastightness and impact resistance.

Figure 7:
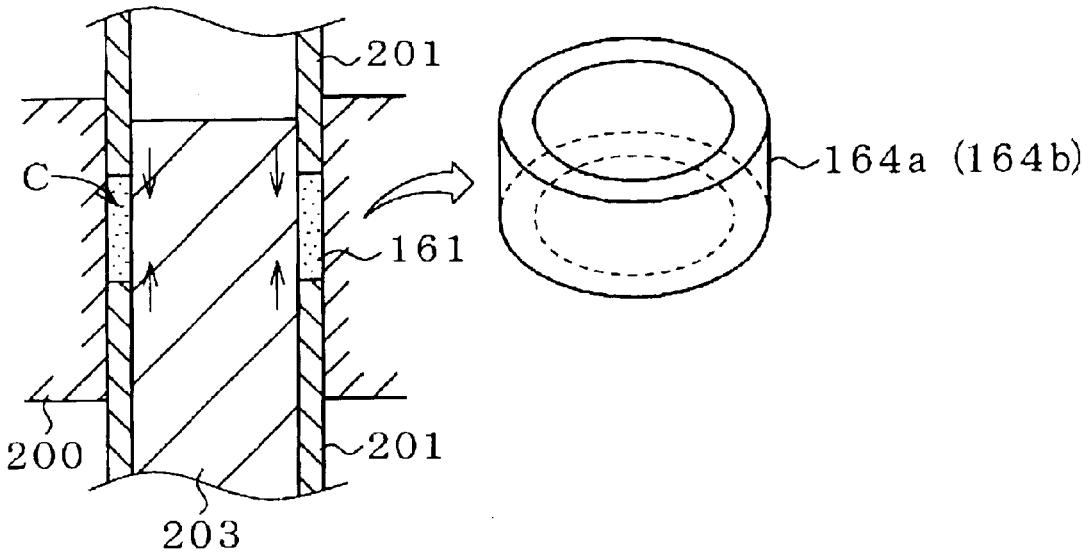
FIG. 7 shows explanatory views exemplifying a step of a method for manufacturing a spark plug according to a second embodiment of the present invention.

According to the above-described embodiment, a charge unit is preliminarily compressed in the gap 20. However, in place of powder, a preliminarily formed ringlike green body 164*a* (164*b*) may be charged into the gap 20. Specifically, as shown in FIG. 7, the sealing material powder 160 is preliminarily formed into a plurality of ringlike green bodies 164*a* (164*b*), which serve as charge units. A cylindrical punch 201 is inserted into a die 200, while a core 203 is disposed inside the punch 201, thereby forming a ringlike cavity C. A charge unit 161 is charged into the cavity C. Another punch 201 is inserted into the die 200 so as to uniaxially press the charge unit 161, thereby yielding the ringlike green body 164*a* (164*b*).

Figure 5:
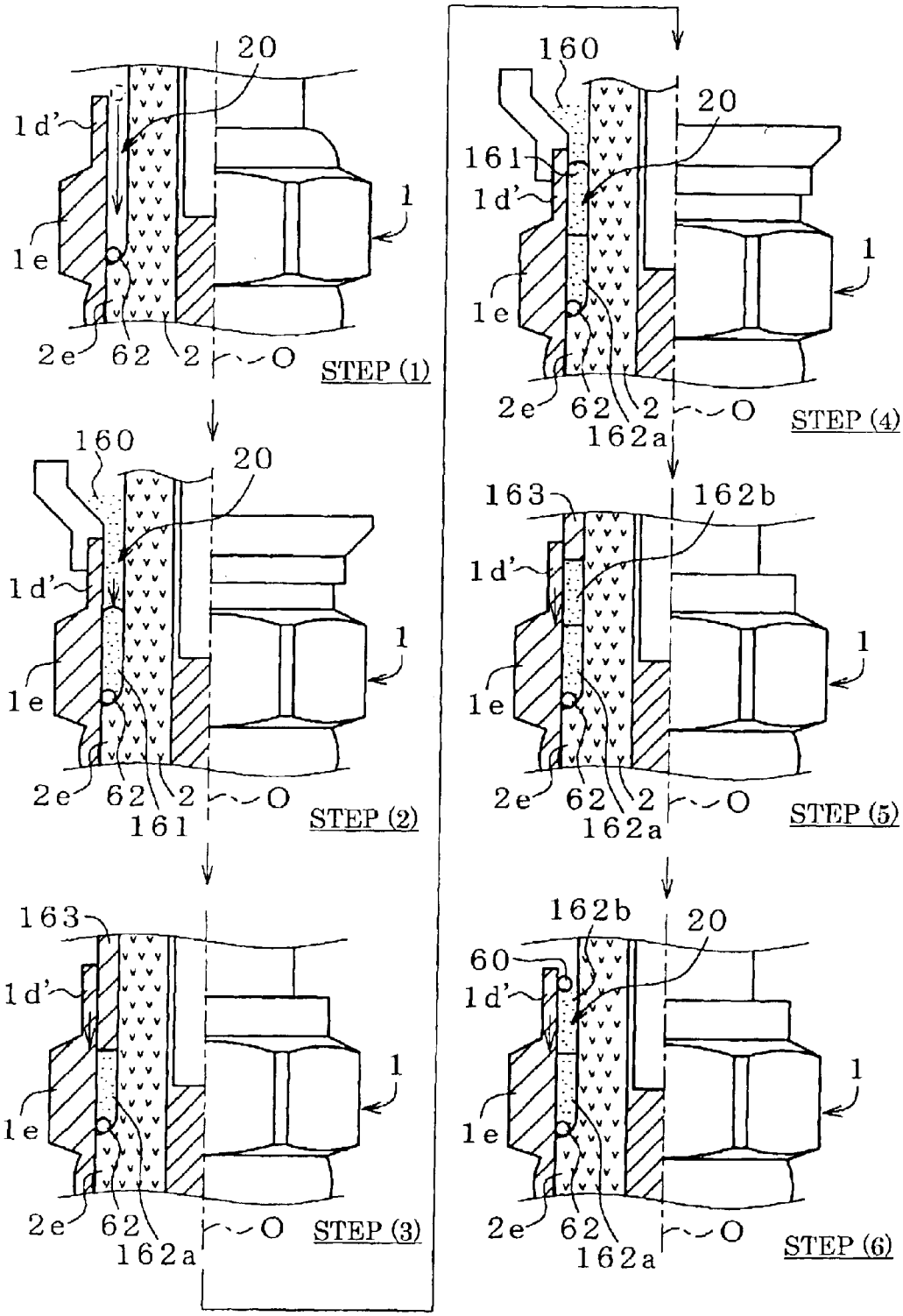
FIG. 5 shows explanatory views exemplifying steps of a method for manufacturing a spark plug according to a first embodiment of the present invention.
Figure 8:
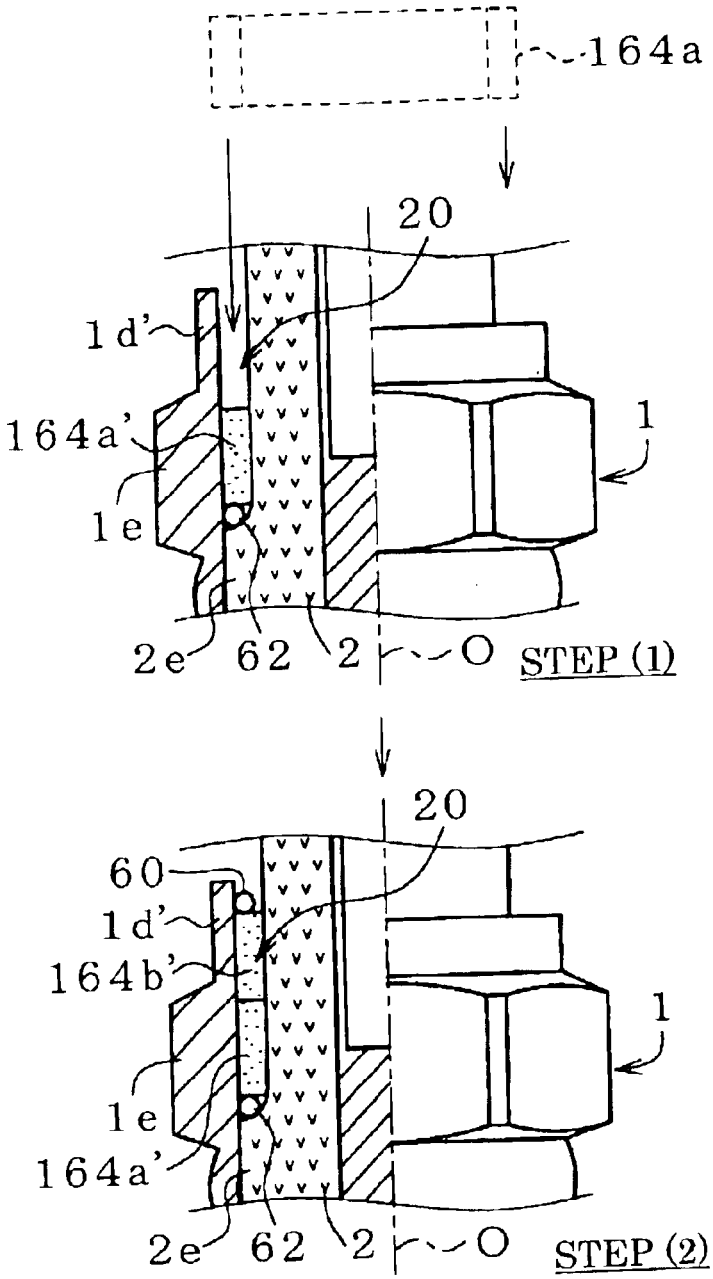
FIG. 8 shows explanatory views exemplifying steps subsequent to that of FIG. 7.

As shown in Step (1) of FIG. 8, a step of inserting one green body 164*a* (164*b*) into the gap 20 in the direction of the axis O and preliminarily compressing the green body 164*a* (164*b*) in the gap 20 by use of a punch 163 similar to that shown in FIG. 5 is repeated to thereby form preliminarily compressed sealing-material-powder layers 164*a*' and 164*b*' from the green bodies 164*a* and 164*b*, respectively, as shown in Step (2). The subsequent process is completely the same as that shown in FIG. 6. Notably, satisfactory compression force to be applied in the course of formation of the green body 164*a* (164*b*) is to such an extent as to impart to the green body 164*a* (164*b*) a strength capable of withstanding handling involved in charging into the gap 20. A force to be applied for preliminarily compressing the green body 164*a* (164*b*) in the gap 20 can be set greater than the compression force applied in the course of formation of the green body 164*a* (164*b*).

EXAMPLES

In order to confirm the effect of the present invention, the tests described below were conducted. However, the present invention should not be construed as being limited thereto.

Samples of the spark plug shown in FIGS. 1 and 2 were manufactured as described below. The metallic shells 1 were formed from a cold-forging carbon steel such that the male-threaded portion 7 had a nominal size of M12 and such that the tool engagement portion 1*e* having a hexagonal cross section had an opposite side-to-side dimension of 14 mm. The insulators 2 were configured such that the protruding height of the protrusion 2*e* were set to various values ranging from 9.4 mm to 12 mm and such that a body portion 2*m* extending rearward from the protrusion 2*e* in the direction of the axis O had a diameter of 9 mm. In this manner, the width M of the gap 20 was varied in the range of 0.2 mm to 1.5 mm. Also, the height L after crimping was varied in the range of 0 mm to 12.5 mm.

A sealing material powder was prepared in the following composition: 85% by mass talc powder, 1% by mass dolomite powder, 10% by mass magnesite powder, and 4% by mass water. The sealing material powder was divided into two charge units of the same quantity. The charge units were charged into the gap 20 according to the method shown in FIG. 5, and then the crimping process shown in FIG. 6 was carried out, thereby yielding spark plug samples. In compression of the sealing material powder, the preliminary compression force was 1,000 kg, and the crimping force was 4,000 kg. Comparative samples were manufactured such that the sealing material powder was charged at one time instead of being charged in charge units.

The thus-prepared spark plug samples were subjected to the tests described below.

(1) Impact resistance test: The male-threaded portion 7 of each of the spark plugs 100 is screwed into a threaded hole formed in a sample fixation base such that the body portion 2*m* of the insulator 2 of FIG. 1 projects upward. An arm is pivotably attached to a pivot located above the body portion 2*m* on the axis O of the insulator 2. The arm has a length of 330 mm. The position of the pivot is determined such that, when the arm is swung down to the body portion 2*m* of the insulator 2, the distal end position of the arm is located 10 mm vertically downward from the rear end face of the insulator 2. The distal end of the arm is raised so as to establish a predetermined pivotal angle with respect to the axis of the arm. Then, the distal end of the arm is released so as to undergo free fall toward a rear part of the body portion 2*m*. The pivotal angle is increased at 2° intervals, and the free fall is repeated at each pivotal angle, thereby obtaining impact resistance angle θ at which the insulator 2 breaks. Higher angle θ indicates that impact resistance is better.

Figure 9:
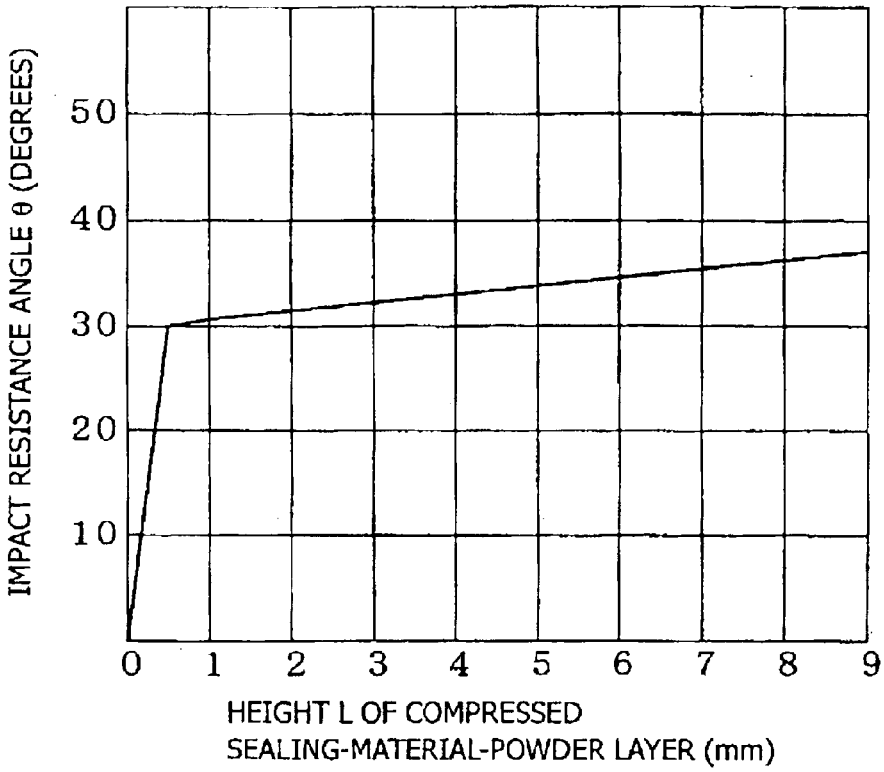
FIG. 9 is a first graph showing the results of the tests described in the Examples section.

FIG. 9 shows the relationship between L and the impact resistance angle θ of the samples which were manufactured according to the method of the present invention, in which the sealing material is divided into charge units. The relationship was measured while L was varied with M fixed to 0.9 mm. As is apparent from FIG. 9, the impact resistance angle θ is large at an L of 0.5 mm or greater, indicating that sufficient impact resistance is attained.

Table 1 shows the results of similar measurement which was conducted while M was varied with L fixed to 4 mm. The criteria are as follows: good (O): impact resistance angle θ 30° or greater; and poor (X): less than 30°. As is apparent from Table 1, sufficient impact resistance is attained at M ranging from 0.5 mm to 1.3 mm.

TABLE 1

| Dimension M (mm) | 0.2 mm | 0.5 mm | 1.0 mm | 1.3 mm | 1.5 mm |
|---|---|---|---|---|---|
| Impact resistance | X | O | O | O | X |

(2) Hot gastightness test: The spark plugs are pretreated. Specifically, the spark plugs are heated to 200° C. and subjected to continuous vibration for 16 hours under the conditions described in ISO 15565 (vibration frequency: 50–500 Hz; sweep rate: 1 octave/minute; acceleration: 30 GN; and vibrating direction: perpendicular to axis O of spark plug). Each of the pretreated spark plugs is attached to a pressure chamber via the male-threaded portion 7 such that the spark discharge gap g is exposed to the interior of the chamber. The interior of the chamber is pressurized to 2 MPa by means of compressed air. In this state, while the chamber surface in contact with the gas seal portion of a spark plug is heated by means of a heater, air leakage from the crimped portion 1*d* is measured. When the air leakage is 10 cc/min, the temperature of the gas seal portion is measured as gastightness critical-temperature.

Figure 10:
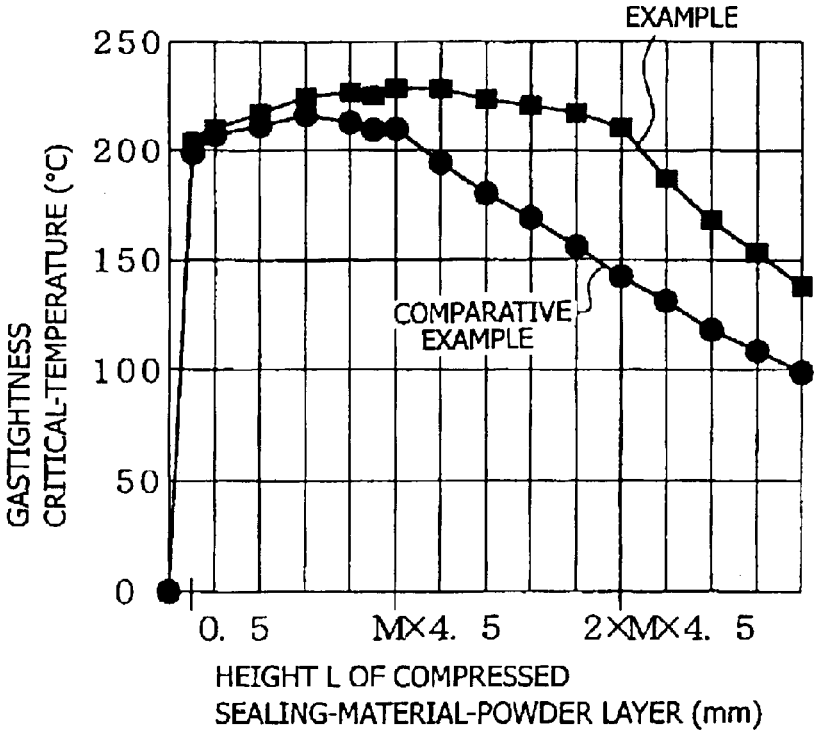
FIG. 10 is a second graph showing the results of the tests described in the Examples section.

FIG. 10 is a graph showing the relationship between L and gastightness critical-temperature as measured while L was varied with M fixed to 0.9 mm. As is apparent from FIG. 10, the spark plugs of Example of the present invention show high gastightness critical-temperature at an L not greater than 2×M×4.5 (mm). The spark plugs of the Comparative Example, in which the powder is not divided into charge units, show a drop in gastightness critical-temperature at an L greater than M×4.5 (mm), indicating apparent inferiority to those of the Example.

While the invention has been described in detail and with reference to specific embodiments thereof, it will be apparent to one skilled in the art that various changes and modifications can be made therein without departing from the spirit and scope thereof.

This application is based on Japanese Patent Application No. 2002-51257 filed Feb. 27, 2003, incorporated herein by reference in its entirety.

What is claimed is:

1. A method for manufacturing a spark plug comprising a tubular metallic shell and a rodlike insulator axially inserted into said metallic shell, said spark plug having a spark discharge gap at one end of said insulator with respect to a direction of an axis of said insulator, a side toward said spark discharge gap with respect to the direction of said axis of said insulator being defined as a front side, said spark plug further comprising the features that:

said metallic shell is configured such that a crimped portion is formed at a rear end portion thereof so as to be curved toward an outer circumferential surface of said insulator, and such that a tool engagement portion having an opposite side-to-side dimension of not greater than 14 mm is formed in an outer surface region adjacent to a front side of said crimped portion;

said insulator is located into said metallic shell in the direction of said axis and a compressed sealing-material-powder layer is provided in a circumferential gap formed between an inner circumferential surface of a rear end portion of said metallic shell and an outer circumferential surface of said insulator; and said compressed sealing-material-powder layer is formed from a sealing material powder which contains talc in an amount of from 75% to 99.7% by mass and at least one of magnesite and dolomite in a total amount of from 0.3% to 25% by mass, and satisfies $$0.5 \leqq M \leqq 1.3 \text{ and}$$

$$0.5 \leqq L \leqq 2\times(M\times 4.5),$$

wherein L in mm represents height as measured in the direction of said axis, and M in mm represents thickness as measured radially with respect to said axis, and has a density in the range of from 2 to 2.9 g/cm$^3$, said method comprising:

a sealing-material-powder charging step which comprises inserting said insulator into said metallic shell in the direction of said axis, and charging a sealing material powder into a circumferential gap formed between an inner circumferential surface of a rear end portion of said metallic shell and an outer circumferential surface of said insulator, such that said sealing material powder is divided into a plurality of charge units and such that a step of charging one charge unit into said gap and preliminarily compressing said charge unit in said gap is repeated to thereby form preliminarily compressed sealing-material-powder layers in said gap; and a crimping step which comprises curving said portion-to-be-crimped toward the outer circumferential surface of said insulator to thereby be crimped, whereby said preliminarily compressed sealing-material-powder layers are formed into a compressed sealing-material-powder layer which satisfies $$0.5 \leqq M \leqq 1.3 \text{ and}$$

$$0.5 \leqq L \leqq 2\times(M\times 4.5),$$

wherein L in mm represents height as measured in the direction of said axis, and M in mm represents thickness as measured radially with respect to said axis.

2. The method for manufacturing a spark plug as claimed in claim 1, wherein, before being charged into said gap, said charge units are formed into a plurality of corresponding ringlike green bodies by means of preliminary forming; and a step of inserting one of said green body into said gap in the direction of said axis and preliminarily compressing said green body in said gap is repeated to thereby form preliminarily compressed sealing-material-powder layers.

3. A spark plug comprising a tubular metallic shell and a rodlike insulator axially inserted into said metallic shell, said spark plug having a spark discharge gap at one end of said insulator with respect to a direction of an axis of said insulator, a side toward said spark discharge gap with respect to the direction of said axis of said insulator being defined as a front side, said spark plug further comprising the features that:

said metallic shell is configured such that a crimped portion is formed at a rear end portion thereof so as to be curved toward an outer circumferential surface of said insulator, and such that a tool engagement portion having an opposite side-to-side dimension of not greater than 14 mm is formed in an outer surface region adjacent to a front side of said crimped portion;

said insulator is located into said metallic shell in the direction of said axis and a compressed sealing-material-powder layer is provided in a circumferential gap formed between an inner circumferential surface of a rear end portion of said metallic shell and an outer circumferential surface of said insulator; and said compressed sealing-material-powder layer is formed from a sealing material powder which contains talc in an amount in the range of from 75% to 99.7% by mass and at least one of magnesite and dolomite in a total amount of from 0.3% to 25% by mass, and satisfies $$0.5 \leqq M \leqq 1.3 \text{ and}$$

$$0.5 \leqq L \leqq 2\times(M\times 4.5),$$

wherein L in mm represents height as measured in the direction of said axis, and M in mm represents thickness as measured radially with respect to said axis, and has a density in the range of from 2 to 2.9 g/cm$^3$.

4. A method for manufacturing a spark plug comprising a tubular metallic shell and a rodlike insulator axially inserted into said metallic shell, said spark plug having a spark discharge gap at one end of said insulator with respect to a direction of an axis of said insulator, a side toward said spark discharge gap with respect to the direction of said axis of said insulator being defined as a front side, said spark plug further comprising the features that:

said metallic shell is configured such that a crimped portion is formed at a rear end portion thereof so as to be curved toward an outer circumferential surface of said insulator, and such that a tool engagement portion having an opposite side-to-side dimension of not greater than 14 mm is formed in an outer surface region adjacent to a front side of said crimped portion;

said insulator is located into said metallic shell in the direction of said axis and a compressed sealing-material-powder layer is provided in a circumferential gap formed between an inner circumferential surface of a rear end portion of said metallic shell and an outer circumferential surface of said insulator; and said compressed sealing-material-powder layer is formed from a sealing material powder which contains talc in an amount of from 75% to 99.7% by mass and at least one of magnesite and dolomite in a total amount of from 0.3% to 25% by mass, and satisfies $$0.5 \leqq M \leqq 1.3 \text{ and}$$

$$0.5 \leqq L \leqq 2 \times (M \times 4.5),$$

wherein L in mm represents height as measured in the direction of said axis, and M in mm represents thickness as measured radially with respect to said axis, and has a density in the range of from 2 to 2.9 g/cm$^3$, said method comprising the steps of:

(a) charging a portion of said sealing material powder into said circumferential gap;

(b) preliminarily compressing the portion of said sealing material powder charged in said circumferential gap; and (c) charging another portion of said sealing material powder into said circumferential gap.

5. The spark plug as claimed in claim 3, wherein the sealing-material-powder layer is formed by charging a preliminarily formed ring-like green body of a sealing material powder in said circumferential gap.

* * * * *